United States Patent [19]

Speraw

[11] Patent Number: 4,826,263

[45] Date of Patent: May 2, 1989

[54] APPARTAUS FOR COUPLING TOGETHER TWO CABINETS OR THE LIKE

[75] Inventor: Floyd G. Speraw, Lexington, S.C.

[73] Assignee: NCR Corporation, Dayton, Ohio

[21] Appl. No.: 750,726

[22] Filed: Jun. 28, 1985

[51] Int. Cl.[4] ..... F16B 12/00

[52] U.S. Cl. ..... 312/111; 220/23.4

[58] Field of Search ..... 312/107, 108, 111, 198, 312/199; 403/405.1, 406.1, 403, 407.1; 248/222.4, 223.2; 220/23.4

[56] References Cited

U.S. PATENT DOCUMENTS

| | | | |
|---|---|---|---|
| 2,575,857 | 11/1951 | Agee | 220/23.4 X |
| 2,703,912 | 3/1955 | Tinnerman et al. | 403/407.1 |
| 3,731,956 | 5/1973 | Hanley | 312/111 X |
| 3,791,707 | 2/1974 | House | 312/111 |
| 4,433,881 | 2/1984 | Witten et al. | 312/111 X |

FOREIGN PATENT DOCUMENTS

| | | | |
|---|---|---|---|
| 1188285 | 4/1970 | United Kingdom | 220/23.4 |

*Primary Examiner*—Joseph Falk

*Attorney, Agent, or Firm*—Wilbert Hawk, Jr.; Edward Dugas

[57] ABSTRACT

An apparatus is disclosed for quickly coupling together two cabinets or the like, or disconnecting two such coupled cabinets from each other. In a preferred embodiment of the invention a first coupling unit is secured across the lower right side of a first cabinet, while a second coupling unit is secured across the upper left side of a second cabinet. Locking members protrude from each of the first and second coupling units. First keyholes in a first orientation are disposed across the upper right side of the first cabinet adjacent to associated ones of the locking members of the second coupling unit. Similarly, second keyholes in a second orientation are disposed across the lower left side of the second cabinet adjacent to associated ones of the locking members of the first coupling unit. The cabinets are locked together by setting the cabinets against each other, tipping both cabinets in unison from upright positions to tilted positions to cause the locking members of the first coupling unit to slip into associated enlarged portions of the second keyholes and the locking members of the second coupling unit to slip into associated enlarged portions of the first keyholes, and then returning both cabinets to their upright positions to cause the locking members of the first coupling unit to slip into associated narrow portions of the second keyholes and the locking members of the second coupling unit to slip into associated narrow portions of the first keyholes.

8 Claims, 1 Drawing Sheet

FIG. 1
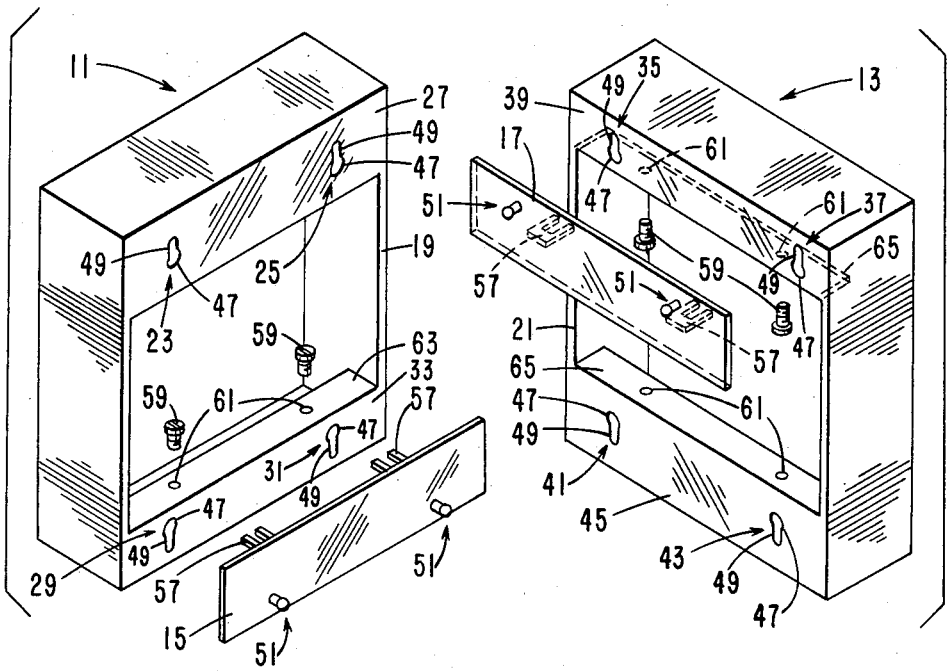
FIG. 2
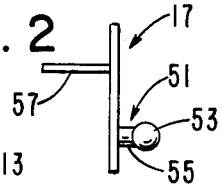
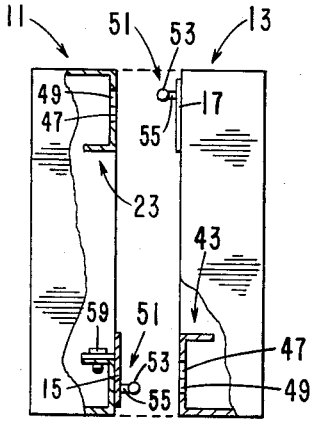
FIG. 3
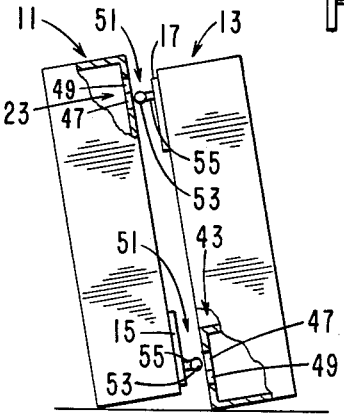
FIG. 4
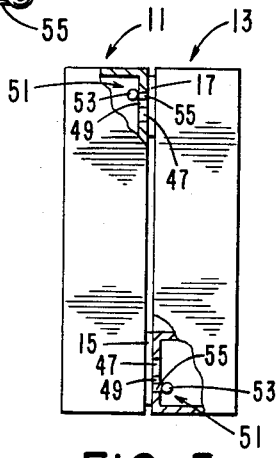
FIG. 5

APPARTAUS FOR COUPLING TOGETHER TWO CABINETS OR THE LIKE

BACKGROUND OF THE INVENTION

1. Field of the Invention

This invention relates to cabinets and more particularly to an apparatus for quickly coupling together two cabinets or the like.

2. Description of the Prior Art

Different types of mechanisms have been proposed for coupling separable cabinets or members together.

U.S. Pat. No. 3,731,956 discloses a connector member for joining together adjacent parallel edges of two separate panels. The two adjacent panels are each provided with a plurality of linearly-aligned, headed bolts which form complementary locking pins. Each headed bolt has a head connected to a shaft. Disposed between the headed bolts on each panel are recesses which are adapted to receive the heads of the bolts from the other panel. The connector member is a substantially flat plate having keyhole slots placed in line with each other. All of the keyhole slots are pointed in the same direction, with each keyhole slot having a large portion and a narrow portion.

To secure the two adjacent panels together, the panels are disposed next to each other and the connector member is placed therebetween so that the headed bolts in each panel are in alignment with the large portions of associated keyhole slots in the connector member and also in alignment with the recesses in the other panel. The panels are moved toward each other such that the headed bolts on each panel are inserted through the large portions of associated keyhole slots on the connector member and into the associated recesses on the other panel. The connector member is then driven downwardly by any suitable means to force the narrow portions of all of the keyhole slots in the connector member to move downward onto the shafts of the headed bolts to lock the panels together.

U.S. Pat. No. 3,791,707 discloses an interlocking device for joining portable food service cabinets and the like in side-by-side relation while at the same time adjusting them to be in substantial vertical and horizontal alignment simply by pushing the cabinets together.

The device includes elongated male and female connector members adapted to be secured horizontally along opposed upper edge portions of the cabinets to be joined. The female connector member has an elongated recess along its length, while the male connector member has an elongated nose member along its length. Both of the female and male connector members are convergently beveled to the outside to serve as horizontal and vertical locating means upon interconnection of the device. A releasable latch mechanism is provided for locking the device in interconnection relation while at the same time providing for manual release for separating the cabinets.

Neither of the above-cited, prior art coupling mechanisms teaches or suggests a means for coupling two cabinets together by using two horizontally positioned coupling units diagonally located on two adjacent cabinets to lock the cabinets together by tilting the cabinets in unison in a scissors action to cause projections on the coupling units to respectively pass into enlarged portions of associated keyholes in the adjacent cabinets and then scissoring the cabinets in unison back to a vertical position to cause the projections on the coupling units to lock into narrow portions of the associated keyholes.

SUMMARY OF THE INVENTION

Briefly, an apparatus is provided for quickly coupling together (or disconnecting) two cabinets.

In accordance with one aspect of the invention, there is provided an assembly comprising, in combination, first and second cabinets, said first cabinet having base and top portions on a first side thereof, said second cabinet having base and top portions on a second side thereof, said top portion of said first cabinet having a plurality of first apertures therethrough with each of said first apertures having first and second portions, said base portion of said second cabinet having a plurality of second apertures therethrough with each of said second apertures having third and fourth portions; a first coupling unit secured along said base portion of said first cabinet; and a second coupling unit secured along said top portion of said second cabinet, each of said first and second coupling units having a plurality of locking members protruding therefrom; said first and second apertures being adapted to respectively receive associated ones of said locking members of said first and second coupling units through said first and third portions thereof when said first and second sides of said first and second cabinets are positioned substantially against each other and then said cabinets are moved in unison from first positions to second positions, and being further adapted to respectively allow associated ones of said locking members of said first and second coupling units to pass into said second and fourth portions thereof to lock said first and second cabinets together when said first and second cabinets are then moved in unison from said second positions back to said first positions.

BRIEF DESCRIPTION OF THE DRAWINGS

Various objects, features and advantages of the invention, as well as the invention itself, will become more apparent to those skilled in the art in the light of the following detailed description taken in consideration with the accompanying drawings wherein like reference numerals indicate like or corresponding parts throughout the several views and wherein:

FIG. 1 is an exploded perspective view of the invention;

FIG. 2 shows an enlarged side view of one of the coupling units shown in FIG. 1; and FIGS. 3–5 are side views illustrating the sequence of positional changes required to lock the cabinets together.

DESCRIPTION OF THE PREFERRED EMBODIMENT

Referring now to FIG. 1, which shows an exploded perspective view of the coupling apparatus of the invention, the coupling apparatus includes cabinets of cases 11 and 13 which are to be selectively coupled together in a side-by-side arrangement by means of elongated adaptors or coupling units 15 and 17.

Cabinet 11 has a side 19 which is to be coupled to an adjacent side 21 of cabinet 13. To enable the adaptors 15 and 17 to selectively couple the cabinets 11 and 13 together, side 19 of cabinet 11 includes a plurality of horizontally spaced apertures 23 and 25 across a top portion 27 and a plurality of horizontally spaced apertures 29 and 31 across a bottom portion 33. A side 21 of cabinet 13 includes a plurality of horizontally spaced apertures 35 and 37 across a top portion 39 and a plurality of horizontally spaced apertures 41 and 43 across a bottom portion 45. Each of the apertures 23, 25, 29, 31, 35, 37, 41 and 43 substantially has a keyhole configuration with an enlarged circular portion 47 and an adjacent slot or elongated or narrow portion 49. However, the keyhole configurations of the apertures 23, 25, 35 and 37 are inversions of the keyhole configurations of the apertures 29, 31, 41 and 43, with the slots 49 of the apertures 23, 25, 35 and 37 pointing upward and the slots 49 of the apertures 29, 31, 41 and 43 pointing downward.

Each of the coupling units 15 and 17 has locking members 51 at opposite ends thereof. An enlarged side view of one of the locking members 51 of the coupling unit 17 is shown in FIG. 2. Each locking member 51, as shown in FIG. 2, as well as in FIGS. 3, 4 and 5, is comprised of a head or button portion 53 coupled via an extension, projection or shaft 55 to an associated portion of an associated one of the coupling units 15 and 17. Each head 53 is smaller than an enlarged portion 47 of any of the apertures 23, 25, 29, 31, 35, 37, 41 and 43 but larger than a slot 49 of any of those apertures, while each shaft 55 is smaller than the slot 49 of any of those apertures. Each of the coupling units 15 and 17 further includes a plurality of ears 57.

Coupling unit 15 is mounted or secured along the bottom portion 33 of cabinet 11 by means of screws 59 passing through the ears 57 of the coupling unit 15 and into internally threaded holes 61 along an elongated flange 63 of the bottom portion 33 of the cabinet 11. On the other hand, the coupling unit 17 is rotated 180 degrees in position (inverted with respect to the coupling unit 15) before being mounted or secured along the top portion 39 of the cabinet 13 by means of screws 59 passing through the ears 57 of the coupling unit 17 and into internally threaded holes 61 along an elongated flange 65 of the top portion 39 of the cabinet 13.

The cabinets 11 and 13, with their respective coupling units 15 and 17 secured thereto, are coupled to each other in three operational steps, as indicated in FIGS. 3, 4 and 5.

First, as shown in the side view of FIG. 3, the cabinets 11 and 13 are moved together into a vertical side-by-side relationship. In this position each head 53 projecting from the coupling unit 15 of cabinet 11 is adjacent to the associated slot 49 of its associated one of the apertures 41 and 43 across the bottom portion 45 of the cabinet 13. Similarly, in this position each head 53 projecting from the coupling unit 17 of cabinet 13 is adjacent to the associated slot 49 of its associated one of the apertures 23 and 25 across the top portion 27 of the cabinet 11.

The cabinets 11 and 13 are then tilted or scissored in unison to the left, as shown in FIG. 4, until the heads 53 of the coupling unit 17 move downward with respect to the cabinet 11 to positions adjacent to the enlarged portions 47 of the apertures 23 and 25. At the same time the heads 53 of the coupling unit 15 move upward with respect to the cabinet 13 to positions adjacent to the enlarged portions 47 of the apertures 41 and 43. The cabinets 11 and 13 are then pushed together in their tilted positions, causing the heads 53 and associated shafts 55 of the coupling unit 17 to enter the associated enlarged portions 47 of the apertures 23 and 25, and the heads 53 and associated shafts 55 of the coupling unit 15 to enter the associated enlarged portions 47 of the apertures 41 and 43. At this time the shafts 55 of the coupling units 15 and 17 are respectively positioned in the associated enlarged portions 47 of the apertures 23 and 25 of the cabinet 11 and of the apertures 41 and 43 of the cabinet 13.

Finally, as shown in FIG. 5, the cabinets 11 and 13 are then returned in unison from their tilted positions to their upright or vertical positions in another scissoring movement. This return movement of the cabinets 11 and 13 causes the shafts 55 of the coupling unit 17 of cabinet 13 to slide up into the associated slots 49 of the apertures 23 and 25 of the cabinet 11, and the shafts 55 of the coupling unit 15 of cabinet 11 to slide down into the associated slots 49 of the apertures 41 and 43 of the cabinet 13. This dual action or scissor action locks the coupling units 15 and 17 into the slots 49 of the associated ones of the apertures 23, 25, 41 and 43 of the adjacent cabinets 11 and 13 to, therefore, lock the cabinets 11 and 13 together.

To quickly unlock or decouple the coupled-together cabinets 11 and 13 of FIG. 5 from each other, the reverse procedure is used. The coupled-together cabinets 11 and 13 of FIG. 5 are tilted together to the left until the shafts 55 of the coupling unit 17 of cabinet 13 slide down into the associated enlarged portions 47 of the apertures 23 and 25 of the cabinet 11 and the shafts 55 of the coupling unit 15 of cabinet 11 slide up into the associated enlarged portions of the apertures 41 and 43 of the cabinet 13. The tilted cabinets 11 and 13 are then pulled slightly apart, causing the heads 53 of the coupling units 17 and 15 to be withdrawn from the associated enlarged portions 47 of the associated ones of the apertures 23, 25, 41 and 43, as indicated in FIG. 4. Then the cabinets 11 and 13 are returned to their upright positions to obtain the two separated cabinets 11 and 13 shown in FIG. 3.

It should be noted at this time that the cabinets 11 and 13 can be made of any suitable material, such as sheet metal or wood. Preferrably the heads 53 of the coupling units 15 and 17 are made of nylon or plastic, and the remaining portions of the coupling units 15 and 17 are made of a sheet metal, such as stainless steel. However, the invention should not be limited to the types of materials that the cabinets 11 and 13 and the coupling units 15 and 17 are comprised of since their compositions can vary as a function of the particular type of application that is desired.

The invention thus provides an apparatus for quickly coupling together two cabinets or the like, or disconnecting two such coupled cabinets from each other.

While the salient features of the invention have been illustrated and described, it should be readily apparent to those skilled in the art that many other changes and modifications can be made in the apparatus of the invention presented without departing from the spirit and true scope of the invention. For example, it should be realized that any other suitable means could be used for mounting or securing a coupling unit 15 or 17 to a cabinet 11 or 13 and that a particular type of such mounting means is not a critical aspect of this invention. For example, enclosed rings (not shown) instead of the ears 57 could be used, with the enclosed rings being screwed, bolted or riveted into the flat, or even recessed, sides of a cabinet without using flanges at all. Accordingly, the present invention should be considered as encompassing all such changes and modifications of the invention that fall within the broad scope of the invention as defined by the appended claims.

I claim:

1. An assembly comprising:

first and second substantially rectangular cabinets, each of said first and second cabinets having first and second side members with each side member having upper and lower portions, each of said upper portions having a plurality of first apertures therethrough, each said first aperture having an upper narrow portion and a lower enlarged portion, each of said lower portions having a plurality of second apertures therethrough, each said second aperture having an upper enlarged portion and a lower narrow portion;

first and second coupling units, each of said coupling units having a plurality of locking members protruding therefrom, each of said locking members having a head portion larger than said narrow portion of said apertures and an elongated shaft coupled between said head portion and an associated said coupling unit;

first attachment means for securing said first coupling unit to said lower portion of said first side member of said first cabinet in a first orientation therewith; and second attachment means for securing said second coupling unit to said upper portion of said second side member of said second cabinet in a second orientation therewith;

said first and second apertures being adapted to respectively receive associated ones of said heads of said locking members of said first and second coupling units through said enlarged portions thereof when said first and second cabinets are selectively, positioned against each other and then moved in unison from first positions to second positions, and being further adapted to respectively allow associated ones of said elongated shafts of said locking members of said first and second coupling units to slide into associated ones of said narrow portions thereof to lock said first and second cabinets together when said first and second cabinets are then moved in unison from said second positions back to said first positions.

2. The assembly of claim 1 wherein said apertures have keyhole configurations.

3. The assembly of claim 1 wherein each of said first apertures has a keyhole configuration which points upward; and each of said second apertures has a keyhole configuration which points downward.

4. The assembly of claim 1 wherein:

each of said head portions is smaller than said enlarged portion of each of said first and second apertures and larger than said narrow portions of each of said first and second apertures; and each of said elongated shafts is smaller than said narrow portion of each of said apertures.

5. An assembly comprising:

a first cabinet having base and top portions on a first side thereof, said top portion having a plurality of first apertures therethrough;

a second cabinet having base and top portions on a second side thereof, said base portion having a plurality of second apertures therethrough;

first coupling means releasably attached along said base portion of said first cabinet, said first coupling means having a plurality of first locking members for moving into locking engagement with said plurality of second apertures upon relative movement of said first and second sides; and second coupling means releasably attached along said top portion of said second cabinet, said second coupling means having a plurality of second locking members for moving into locking engagement with said plurality of first apertures upon the relative movement of said first and second sides.

6. The assembly of claim 5, and wherein said first and second apertures have keyhole shapes having an enlarged portion and a narrower slot portion, the direction of relative movement for locking engagement being determined by the orientation of the keyhole shapes of said first and second apertures.

7. The assembly of claim 6, and wherein each of said locking members comprises an enlarged head portion sized to fit through said enlarged portion of a corresponding one of said keyhole shaped apertures, and a shaft portion for moving into said slot portion of a corresponding one of said keyhole shaped apertures, during relative movement of said first and second sides so that locking engagement is made between the locking members and corresponding ones of said apertures.

8. The assembly of claim 7, and wherein said first and second coupling means and said first and second plurality of apertures are spaced, and the keyhole shapes of the apertures are oriented such that said heads of said locking members are moved into alignment with said enlarged portion of corresponding ones of said keyhole shaped apertures when said first and second cabinets are tipped in unison to a tipped position, and that with said heads of said locking members through said enlarged portions of said keyhole shaped apertures, said shaft portions of said locking members move into said slot portions of said corresponding ones of said keyhole shaped apertures when said first and second cabinets are stood upright in unison from the tipped position.

* * * * *